US008103040B2

(12) United States Patent
Pelland et al.

(10) Patent No.: US 8,103,040 B2
(45) Date of Patent: Jan. 24, 2012

(54) ADJUSTABLE, DUAL SPEAKER ELEMENT IN-EAR PHONE

(75) Inventors: Michael J. Pelland, Princeton, WI (US); Ronaldo J. Santiago, South Elgin, IL (US); James J. Potter, Atlanta, GA (US); Mandy M. Johnson, Milwaukee, WI (US); Allan G. Mlodzikowski, Muskego, WI (US); Michael J. Koss, Milwaukee, WI (US)

(73) Assignee: Koss Corporation, Milwaukee, WI (US)

( * ) Notice: Subject to any disclaimer, the term of this patent is extended or adjusted under 35 U.S.C. 154(b) by 0 days.

(21) Appl. No.: 12/990,431

(22) PCT Filed: May 18, 2009

(86) PCT No.: PCT/US2009/044340

§ 371 (c)(1),
(2), (4) Date: Jan. 21, 2011

(87) PCT Pub. No.: WO2009/143055

PCT Pub. Date: Nov. 26, 2009

(65) Prior Publication Data

US 2011/0103636 A1 May 5, 2011

Related U.S. Application Data

(60) Provisional application No. 61/054,238, filed on May 19, 2008.

(51) Int. Cl.
*H04R 25/00* (2006.01)

(52) U.S. Cl. ..... 381/381; 381/374

(58) Field of Classification Search ..... 381/381
See application file for complete search history.

(56) References Cited

U.S. PATENT DOCUMENTS

| | | | |
|---|---|---|---|
| 2,337,953 | A | 12/1943 | Wirsching |
| D233,444 | S | 10/1974 | Christian et al. |
| 4,418,248 | A | 11/1983 | Mathis |
| D272,904 | S | 3/1984 | Kawano |
| 4,453,050 | A | 6/1984 | Enokido |
| 4,668,842 | A | 5/1987 | Yokoyama et al. |
| D293,107 | S | 12/1987 | Muller |
| 5,147,986 | A | 9/1992 | Cockrum et al. |
| 5,210,792 | A | 5/1993 | Kajihara |
| 5,333,206 | A | 7/1994 | Koss |
| 5,410,608 | A | 4/1995 | Lucey et al. |

(Continued)

OTHER PUBLICATIONS

International Preliminary Report on Patentability for PCT/US09/44340, Dec. 3, 2010 (13 pages).
International Search Report and Written Opinion for PCT/US2009/044340, Jul. 7, 2009 (12 pages).

(Continued)

*Primary Examiner* — Brian Ensey
(74) *Attorney, Agent, or Firm* — K&L Gates LLP

(57) ABSTRACT

An adjustable, dual speaker element earphone. One of the speaker elements is sized to fit into the cavum concha of the listener's ear and the other element (is not. A hinged joint may allow the larger speaker element may be rotated about a vertical axis of the hinged joint so that the larger speaker element can be rotated towards or away from the listener's ear. The speaker elements may be connected such that sounds produced by both speaker elements emanate from different respective sound openings defined in a surface of the smaller speaker element. Also, one or both of the speaker elements may be operably connected to a hanger bar that is sized and configured to rest on an upper portion of the listener's ear.

52 Claims, 9 Drawing Sheets

U.S. PATENT DOCUMENTS

| | | | | |
|---|---|---|---|---|
| D371,133 | S | 6/1996 | Andrea | |
| D375,959 | S | 11/1996 | Davis et al. | |
| 5,655,026 | A | 8/1997 | Peters et al. | |
| D383,757 | S | 9/1997 | Dobrusskin et al. | |
| D385,272 | S | 10/1997 | Jensen et al. | |
| 5,729,615 | A | 3/1998 | Yang | |
| 5,790,683 | A | 8/1998 | Salzani | |
| D411,540 | S | 6/1999 | Mavrakis et al. | |
| D421,755 | S | 3/2000 | Pitel | |
| 6,097,827 | A | 8/2000 | Yang | |
| D431,235 | S | 9/2000 | Lyman et al. | |
| D460,749 | S | 7/2002 | Liu | |
| 6,427,018 | B1 | 7/2002 | Keliiliki | |
| 6,868,164 | B2 | 3/2005 | Ito et al. | |
| 6,914,997 | B2 | 7/2005 | MacDonald et al. | |
| 7,123,737 | B2 | 10/2006 | Ham | |
| 7,231,056 | B2 | 6/2007 | Chen | |
| 7,245,737 | B2 | 7/2007 | Amae et al. | |
| D556,735 | S | 12/2007 | Yeo et al. | |
| D584,293 | S | 1/2009 | Kim et al. | |
| D601,126 | S | 9/2009 | Christopher et al. | |
| D618,669 | S | 6/2010 | Johnson et al. | |
| 2004/0008855 | A1 | 1/2004 | Ham | |
| 2004/0091129 | A1 * | 5/2004 | Jensen et al. | 381/381 |
| 2008/0080704 | A1 | 4/2008 | te Riet | |

OTHER PUBLICATIONS

Amazon.com: Earphones: Electronics, printed from http://www.amazon.com/Bang-Olufsen-1640611-Earphones/dp/B0... on Apr. 21, 2009, 2 pages.

Amazon.com: Earphones: Electronics, printed from http://www.amazon.com/Bang-Olufsen-1640611-Earphones/dp/B000Q... on Apr. 21, 2009, 7 pages.

Amazon.com: Koss KDE250 Dual Element Stereophone (Black/Silver):E . . . , printed from http://www.amazon.com/Koss-KDE250-Element-Stereophone-Silver/dp... on May 8, 2009, 4 pages.

Amazon.com: Koss CC_01 Isolation Earbud Stereophone (Red/Gray): Ev.., printed from http://www.amazon.com/Koss-CC_01-Isolation-Earbud-Stereophone/dp... on May 8, 2009, 4 pages.

Amazon.com: Koss KDE250 Dual Element Stereophone (Black/Silver):E . . . , printed from http://www.amazon.com/Koss-KDE250-Element-Stereophone-Silver/dp... on Jul. 2, 2009, 5 pages.

Byte-sized: Headphones aren't just white earbuds, printed from http://byte-sized.blogspot.com/2009/01/headphones-arent-just-white-earb... on Jul. 2, 2009, 2 pages.

Koss KDE 250 Earphones at CES.., printed from http://www.gadgetsnews.co.uk/post/2009/01/12/Koss-KDE-250-Earphon... on Jul. 2, 2009, 2 pages.

* cited by examiner

ADJUSTABLE, DUAL SPEAKER ELEMENT IN-EAR PHONE

PRIORITY CLAIM

The present application claims priority to PCT Application No. PCT/US2009/044340, having an international filing date of May 18, 2009, which PCT application claims priority to U.S. provisional application Ser. No. 61/054,238, titled "ADJUSTABLE, DUAL SPEAKER ELEMENT IN-EAR PHONE," filed May 19, 2008, and to U.S. application Ser. No. 29/334,942, filed Apr. 6, 2009, titled "EARPHONE," which are incorporated herein by reference in their entireties.

BACKGROUND

The present disclosure generally relates to earphones for sound reproduction with high fidelity and more particularly to adjustable dual element in-ear earphones having one transducer for each ear directed to reproducing higher frequencies and one transducer for each ear directed to reproducing lower frequencies.

U.S. Pat. No. 5,333,206, titled "DUAL ELEMENT HEADPHONE," discloses a dual element headphone including (a) one transducer that is substantially larger than the cavum concha of a typical human ear and (b) one smaller transducer that fits into the cavum concha. Other than the curvature of the headband, however, the headphones disclosed in this patent are not adjustable.

U.S. Pat. No. 5,729,615, titled "IN-EAR TYPE EARPHONE HAVING AN EAR HANGER," discloses an earphone having one in-ear speaker element connected to a shaft. The speaker element is pivotably rotatable with respect to the shaft. Further, the shaft is slidably movable along its axis. Thus, the position of the earphone can be raised or lowered vertically by sliding the shaft. Further, the earphone can be rotated in the roll direction, but in the roll direction only. Therefore, while the earphone disclosed in this patent discloses some mechanisms for adjusting the position and orientation of the earphone, the permitted adjustments are limited. In addition, the earphone of this patent only has one speaker element.

The foregoing discussion is intended only to illustrate some of the shortcomings present in the field of the invention at the time, and should not be taken as a disavowal of claim scope.

SUMMARY

In various embodiments, an earphone is provided. In at least one embodiment, the earphone can comprise at least one speaker element, a bridge comprising a first end and a second end, wherein the speaker element is pivotably connected to the first end of the bridge, and a hanger bar comprising a first portion and a second portion, wherein the first portion is threadingly connected to the second end of the bridge. In these embodiments, the second portion of the hanger bar is configured to rest upon a part of a listener's ear when worn by the listener.

In at least one embodiment, an earphone is provided that can comprise at least one speaker element, a bridge comprising a first end and a second end, wherein the speaker element is pivotably connected to the first end of the bridge, and a hanger bar comprising a first portion and a second portion. In these embodiments, the second end of the bridge comprises a rotatable knob that is accessible to a listener when the earphone is worn by the listener. Further, in these embodiments, the first portion of the hanger bar is operably engaged to the rotatable knob such that rotation of the knob causes the second portion to at least translate relative to the bridge. Additionally, in these embodiments, the second portion of the hanger bar is configured to rest upon a part of the listener's ear when worn by the listener.

In at least one embodiment, a method of wearing an earphone is provided that can include the steps of providing an earphone comprising at least one speaker element, a bridge comprising a first end and a second end, wherein the speaker element is pivotably connected to the first end of the bridge and wherein the second end comprises a rotatable knob, and a hanger bar comprising a first portion and a second portion, wherein the first portion is operably engaged to the rotatable knob such that rotation of the knob causes the second portion of the hanger bar to at least translate relative to the bridge. In these embodiments, the method further comprises the steps of rotating the knob to adjust a distance between the second portion of the hanger bar and the bridge, rotating the speaker element relative to the bridge, and placing the hanger bar on a part of a listener's ear such that the speaker element is aligned with the cavum concha of the listener's ear.

In at least one embodiment, an earphone is provided that can comprise a first speaker element and a second speaker element extending from the first speaker element. In these embodiments, the first speaker element can comprise an enclosure having a wall, a first transducer disposed within the enclosure, the first transducer configured to produce a first sound, and a first cavity defined between the wall of the enclosure and the first transducer. Further, in these embodiments, the second speaker element can comprise a housing sized and configured to fit at least partially into a cavum concha of a listener's ear, the housing having a backing and a sound emanating surface, wherein the sound emanating surface includes first sound openings and second sound openings defined therein, a second transducer disposed within the housing, the second transducer configured to produce a second sound that emanates through the second sound openings but not through the first sound openings, and a second cavity defined between the backing of the housing and the second transducer. Additionally, in these embodiments, the first cavity, the second cavity, and the first sound openings define a sound path for the first sound produced by the first transducer such that the first sound travels through the sound path and emanates through the first sound openings but not through the second sound openings.

In at least one embodiment, an earphone is provided that can comprise at least one speaker element configured to fit at least partially into a cavum concha of a listener's ear and a hanger bar operably connected to the speaker element. In these embodiments, the hanger bar is configured to rest upon an upper external curvature of a listener's ear and behind an upper portion of an auricula of the listener's ear. Additionally, in these embodiments, the hanger bar has a shape configured to cause the speaker element to exert a force on the listener's ear, independent of gravity.

This Summary is intended to briefly outline certain embodiments of the subject application. It should be understood that the subject application is not limited to the embodiments disclosed in this Summary, and is intended to cover modifications that are within its spirit and scope, as defined by the claims. It should be further understood that this Summary should not be read or construed in a manner that will act to narrow the scope of the claims.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION

Figure 1:
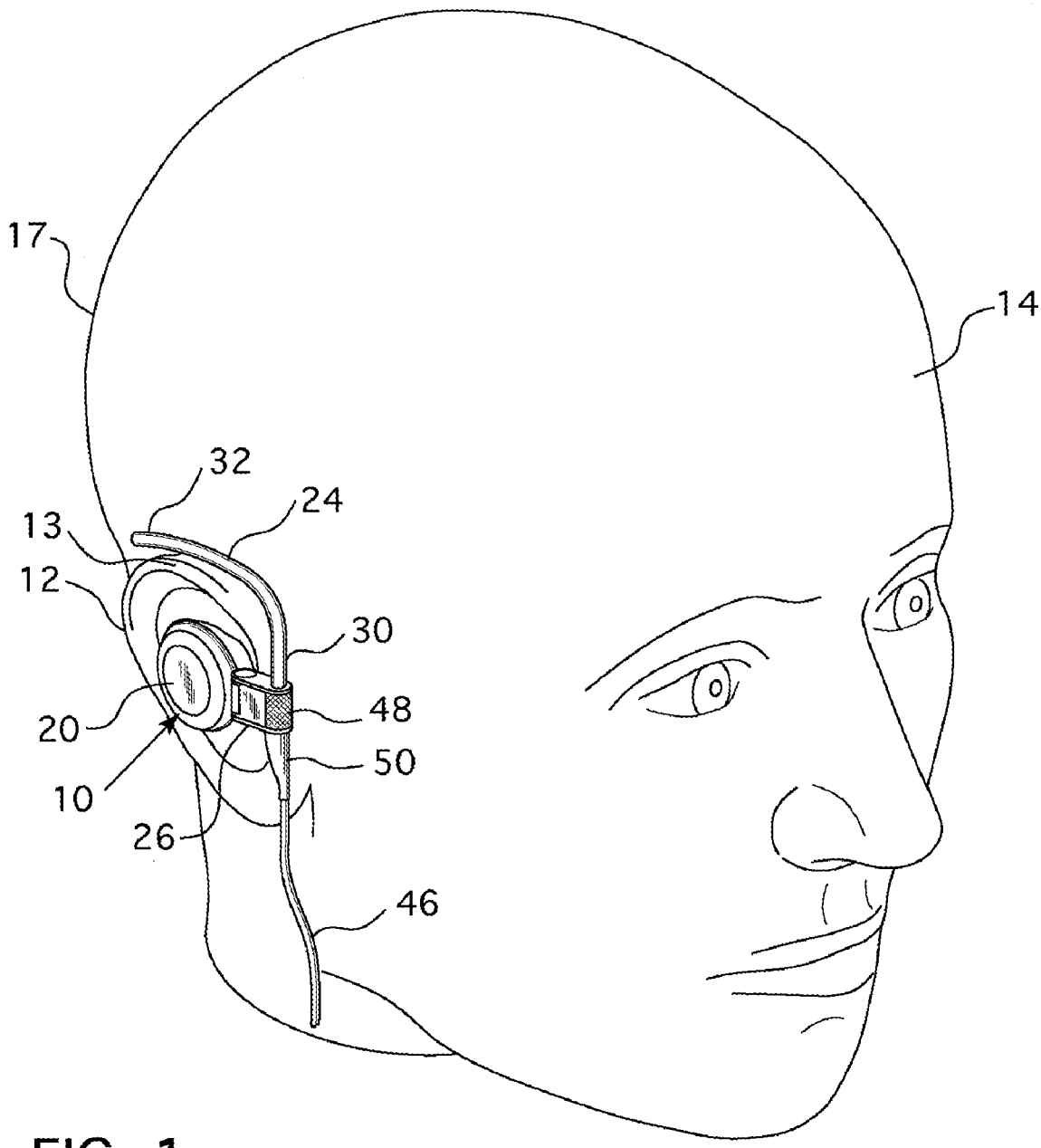
FIG. 1 depicts a non-limiting embodiment of an earphone being worn by a listener.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

In the following description, like reference characters designate like or corresponding parts throughout the several views. In addition, it is to be understood that such terms as "forward," "rearward," "front," "back," "right," "left," "upwardly," "downwardly," and the like are words of convenience and are not to be construed as limiting terms. The description below is for the purpose of describing various embodiments of the invention and is not intended to limit the invention thereto.

Various embodiments are directed to an adjustable, dual speaker element earphone, wherein one of the speaker elements (the smaller one) is sized to fit into the cavum concha of the listener's ear and the other element (the larger one) is not. The positioning of the speaker elements may be adjustable so that the user can adjust the positioning of the speaker elements for increased comfort. For example, in one embodiment, by virtue of a hinged joint, the larger speaker element may be rotated about a vertical axis of the hinged joint so that the larger speaker element can be rotated towards or away from the listener's ear. In addition, according to various embodiments, the smaller speaker element may be adjusted relative to the larger speaker element. For example, in one embodiment, the smaller speaker element may be connected to the larger speaker element by a knuckle-ball joint, a ball joint, or some other similar pivotable joint, that provides multiple degrees of rotational freedom but limits or prevents translational movement for the smaller speaker element relative to the larger speaker element.

In addition, the earphone may comprise a hanger bar that the listener uses to position the earphone on the listener's ear. In that connection, the hanger bar may comprise a horizontal section that rests upon the upper external curvature of the listener's ear behind the upper portion of the auricula (or pinna). The earphone may comprise a knurled knob that allows the user to adjust finely the distance between the horizontal section of the hanger bar and the speaker elements, thereby providing, in such embodiments, another measure of adjustability for the user.

Figure 2:
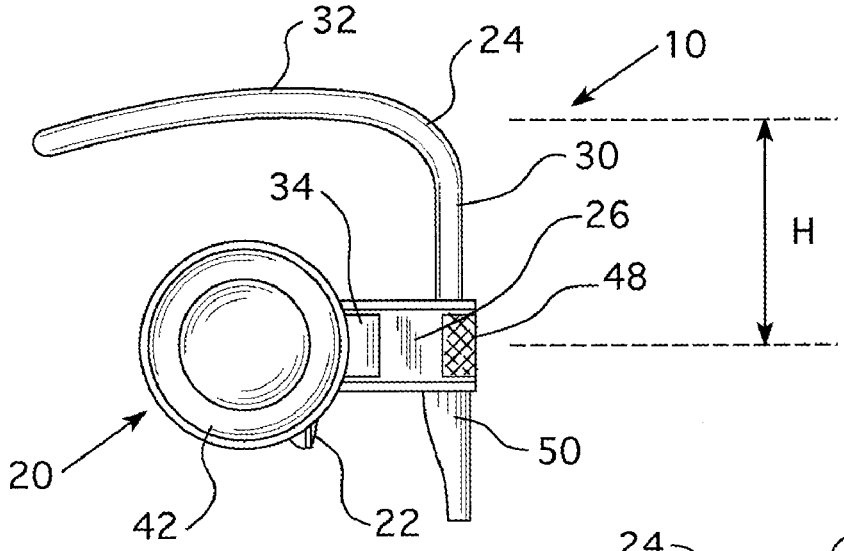
FIG. 2 is a side view of the earphone of FIG. 1.
Figure 3:
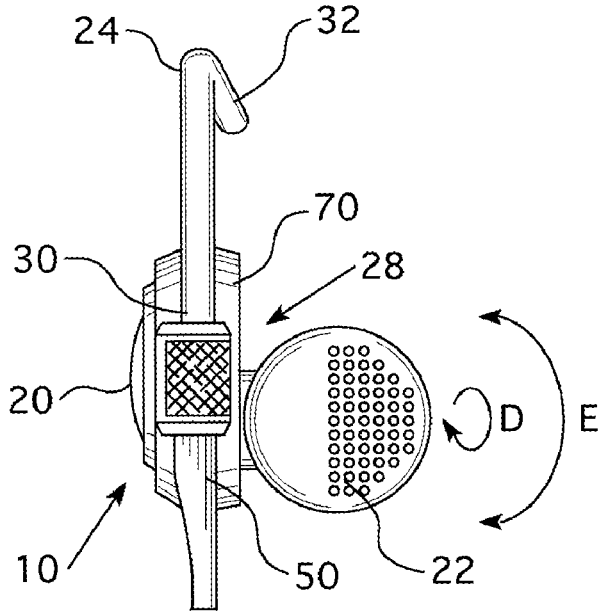
FIG. 3 is a front view of the earphone of FIG. 1.
Figure 4:
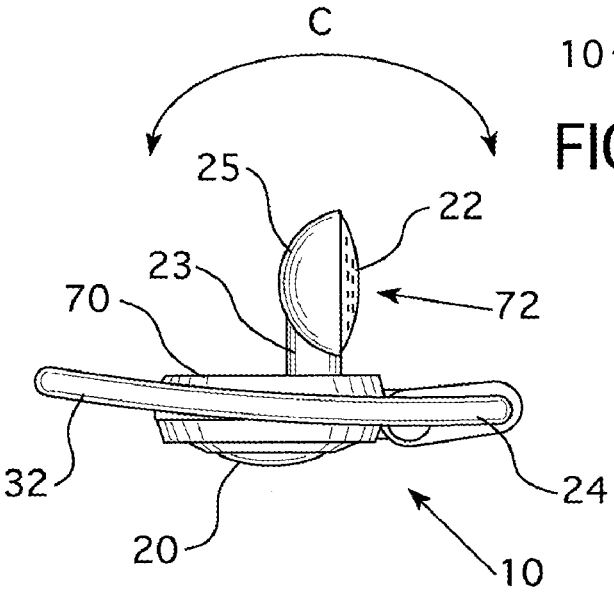
FIG. 4 is a top view of the earphone of FIG. 1.

In at least one embodiment, an adjustable, dual speaker element earphone is provided, wherein one of the speaker elements is sized to fit into the cavum concha of the listener's ear. FIGS. 1 through 4 illustrate one embodiment of the earphone 10. FIG. 1 is a perspective view of the earphone 10 being worn on the ear 12 of a human listener 14; FIG. 2 is a side view of the earphone 10; FIG. 3 is a front view of the earphone 10; and FIG. 4 is a top view of the earphone 10. According to the illustrated embodiment, the earphone 10 comprises, among other elements, a first speaker element 20, a second, in-ear speaker element 22, a hanger bar 24, and a tragel bridge 26.

The terms "proximal" and "distal" are used herein with reference to the listener's head. Accordingly, the proximal components of the earphone 10 are toward the listener's nose, and the distal components are toward the rear of the listener's head. Also, the spatial terms "vertical" and horizontal" are used herein with respect to the drawings. These terms are not intended to be limiting or absolute.

The first speaker element 20 may be generally circular, as shown in the figures, and may be sized large enough that it does not fit into the cavum concha of the vast majority of human listeners 14. The second speaker element 22 also may be generally circular in shape, and may be extend outwardly from an inner portion 28 of the first speaker element 20. According to one embodiment, the second speaker element 22 may be rigidly fixed to the inner surface 28 of the first speaker element 20 so that there is no relative movement between the first and second speaker elements. In such an embodiment, the second speaker element 22 may be connected to the first speaker element 20 by an arm 23 such that the second speaker element 22 extends generally perpendicularly from the first speaker element 20. According to various embodiments, the inner surface 28 of the first speaker element 20, the arm 23, and the backing 25 of the second speaker element 22 may be made from a single piece of injection molded plastic so that their positions are fixed.

The hanger bar 24, as shown in the figures, may be substantially L-shaped, having (i) a first, proximal portion 30 that extends generally vertically from the tragel bridge 26, and (ii) a second, distal portion 32, generally perpendicular to the first portion 30, that extends horizontally away from the first portion 30 and is designed to rest upon the upper external curvature of the ear 12 behind the upper portion 13 of the auricula (or pinna). The hanger bar 24 may have a circular cross-section, and may be made out of plastic, metal, or any other suitable material.

Figure 10:
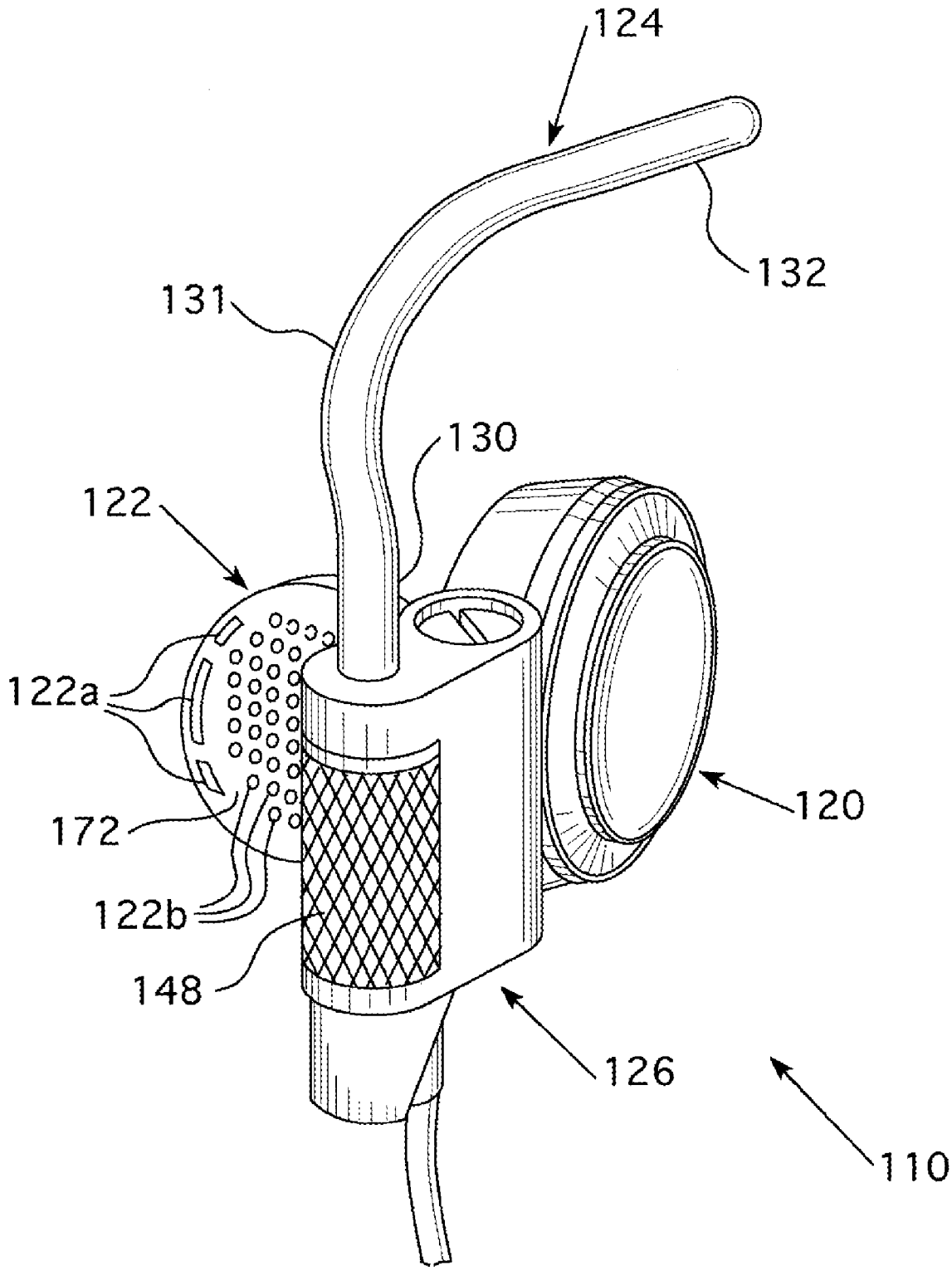
FIG. 10 is a perspective view of a non-limiting embodiment of an earphone.

The tragel bridge 26 includes a vertically oriented, distal gudgeon 34 fixedly connected to the first speaker element 20 at a proximal edge of the first speaker element 20. The gudgeon 34 and the tragel bridge 26 may be generally tangential to a proximal edge of the circular first speaker element 20. A slotted retaining bolt or pintle 36 is inserted through the opening defined by the gudgeon 34 to connect hingedly the first speaker element 20 to the tragel bridge 26. That way, the first speaker element 20 can be rotated about the vertical axis of the gudgeon 34 so that the first speaker element 20 can be rotated toward or away from the listener's ear 12. The gudgeon 34 may be made from metal or plastic, for example. In one embodiment, an outer peripheral backing 42 of the first speaker element 20 and the gudgeon 34 may be made from an integrated piece of injection-molded plastic. The height of the tragel bridge 26 may be less than the diameter of the first speaker element 20. For example, the height of the tragel bridge 26 may be approximately one-half the diameter of the first speaker element 20. Alternatively, referring to FIGS. 10-11, tragel bridge 126 may be larger than one-half the diameter of first speaker element 120, but less than the diameter of the first speaker element 120. In such embodiments, cylindrical knurled knob 148 may be larger than knob 48, described above, such that a listener may have a larger surface area with which to contact and rotate knob 148 to adjust hanger bar 124.

Figure 5:
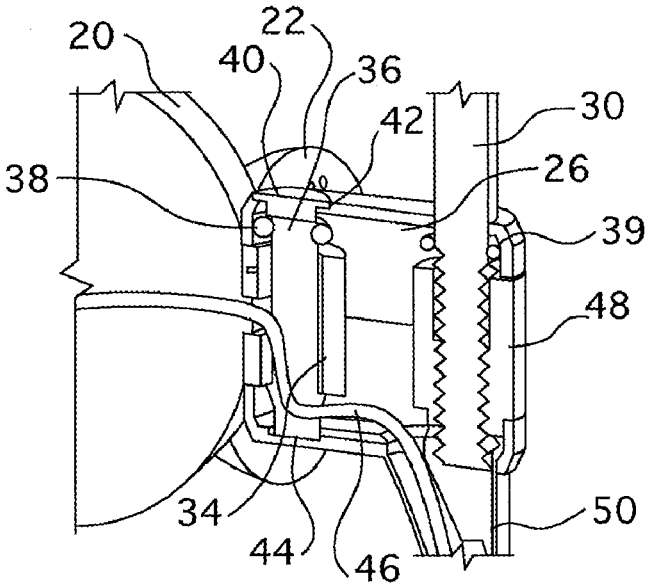
FIGS. 5-7 shows aspects of a tragel bridge of the earphone of FIG. 1.
Figure 6:
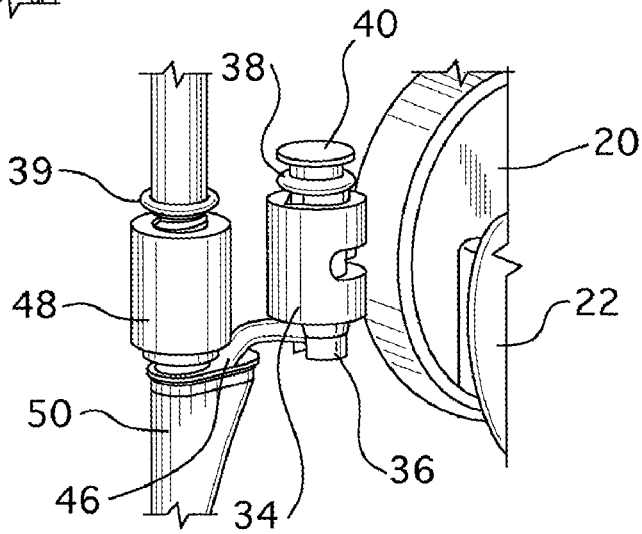
Figure 7:
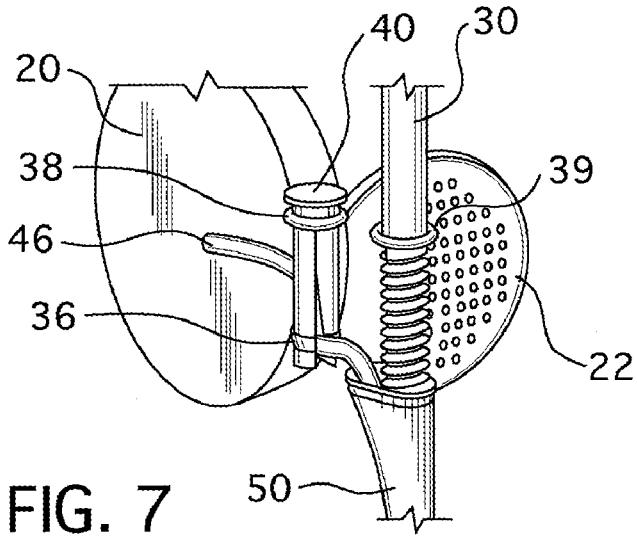

FIGS. 5-7 show aspects of the tragel bridge 26 according to various embodiments. FIG. 5 is a section view of the tragel bridge 26 showing the gudgeon 34 and the pintle 36. In FIGS. 6 and 7, the tragel bridge 26 is omitted so that other components in the tragel bridge 26 can be viewed. As shown in these figures, a plastic friction O-ring 38 may be disposed between the head 40 of the pintle 36 and the upper portion of the gudgeon 34. The O-ring 38 may reside inside the tragel bridge 26 so that it cannot normally be seen. The purpose of the O-ring 38 is to provide friction between the gudgeon 34 and the pintle 36 such that rotation of the first speaker element 20 relative to the tragel bridge 26 is resisted and a relative position may be maintained between the first speak element 20 and the tragel bridge 26. The tragel bridge 26 has upper and lower flanges 42, 44 above and below the gudgeon 34, respectively. The pintle 36 is inserted through the upper flange 42, the gudgeon 34, and the lower flange 44, to thereby hingedly connect the gudgeon 34 to the tragel bridge 26.

As shown in FIGS. 5-7, the pintle 36 may include a lower slot through which a speaker wire 46 may be feed into the tragel bridge 26 and to the first and second speaker elements 20, 22.

As shown in FIGS. 1-7, the tragel bridge 26 may also include a cylindrical knurled knob 48 vertically oriented at a proximal end of the tragel bridge 26. The knurled knob 48 may define a vertical opening therethrough, with threads on the interior of the knurled knob 48 around the opening. The lower end of the first portion 30 of the hanger bar 24 may have corresponding threads, as shown in FIG. 5, which mate with the threads of the knurled knob 48. Rotation of the knurled knob 48 about its vertical axis thereby causes the horizontal portion 32 of the hanger bar 24 to be adjusted vertically with respect to the tragel bridge 26 (and hence the speaker elements 20, 22). That is, by rotating the knurled knob 48, a user can adjust the distance H shown in FIG. 2, which controls the relative positioning of the speaker elements 20, 22 and/or tragel bridge 26 to the second portion 32 of the hanger bar 24, i.e., the portion of the hanger bar 24 that rests upon the listener's ear, to thereby optimize or enhance the fit of the earphone 10 for the user. In at least one embodiment, the threads of the hanger bar 24 and the knurled knob 48 may be relatively fine, to provide fine adjustment for the user. Alternatively, in at least one embodiment, the threads of the hanger bar 24 and the knurled knob 48 may be relatively coarse, to provide coarse adjustment for the user. The knurled knob 48 may be made from plastic or metal, for example.

Further, in at least one embodiment, the knob 48 may be rotated relative to the hanger bar 24 to the point where the threads of the hanger bar 24 disengage from the knurled knob 48. Alternatively, in at least one embodiment, the hanger bar 24 may be rotated relative to the knob 48 such that the threads of hanger bar 24 disengage from the knob 48. In such embodiments, another hanger bar (not shown), having different dimensions of a first portion 30 and/or a second portion 32, may then be inserted into the tragel bridge 26 at knob 48. Accordingly, different sized hanger bars may be provided to fit a variety of people having different sized ears.

According to various embodiments, as shown in FIG. 5, the threads of the lower portion of the first portion of the hanger bar 24 may also pass into an opening in a strain relief member 50 that is adjacent to a lower portion of the tragel bridge 26 at its proximal side. The speaker wire 46 may thread up through the strain relief member, through the tragel bridge 26, and through the slot in the pintle 36 to the speaker elements 20, 22, as shown in FIG. 5. The strain relief member 50 may be made from plastic, for example.

In various embodiments, referring to FIGS. 1-4, hanger bar 24 may be operably connected to the speaker elements 20, 22 by tragel bridge 26. Accordingly, when the earphone 10 is correctly positioned on the listener's ear 12, the tragel bridge 26 usually will be adjacent to the tragus of the listener's ear 12, as shown in FIG. 1. The tragel bridge 26 may be generally rectangular in shape, as shown in FIGS. 1-2, having the gudgeon 34 at its distal end and the knurled knob 48 at is proximal end. The tragel bridge 26 may be made of plastic or any other suitable material.

Figure 14:
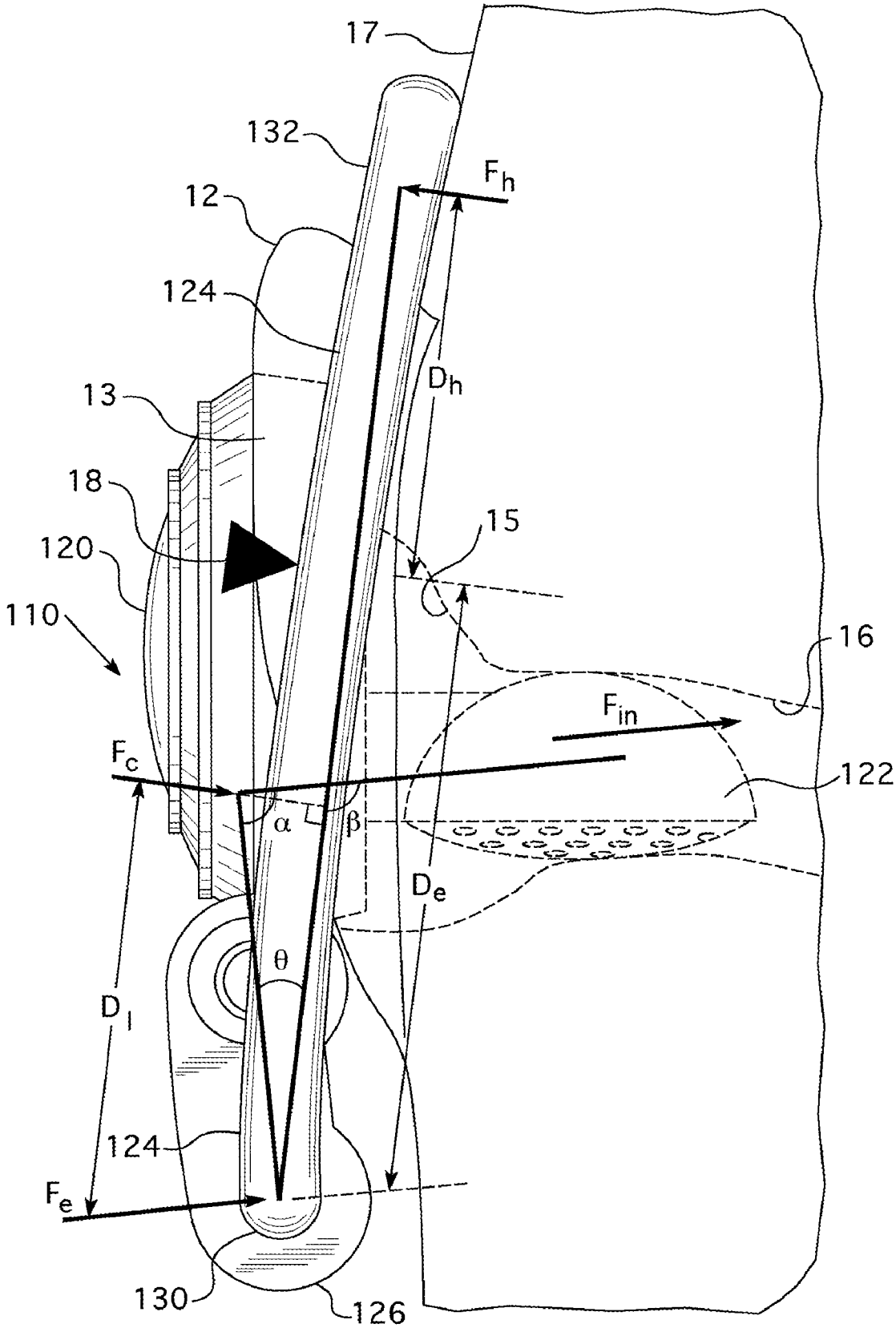
FIG. 14 is a top view of a force diagram showing the forces acting on and exerted by the earphone of FIG. 10 with respect to a listener's ear.

Further, with reference to FIGS. 1 and 14, when earphone 10, 110 is correctly position on the listener's ear 12, the hanger bar 24, 124, as mentioned above, is configured to rest upon the upper external curvature of the listener's ear 12 and behind the upper portion 13 of the auricula of the listener's ear 12. According to various embodiments, the hanger bar 24, 124 may have a shape and size such that the hanger bar 24, 124 is configured to cause the first speaker element 20, 120 and/or the second speaker element 22, 122 to exert a force ($F_{in}$ shown in FIG. 14) on the listeners ear.

Figure 11:
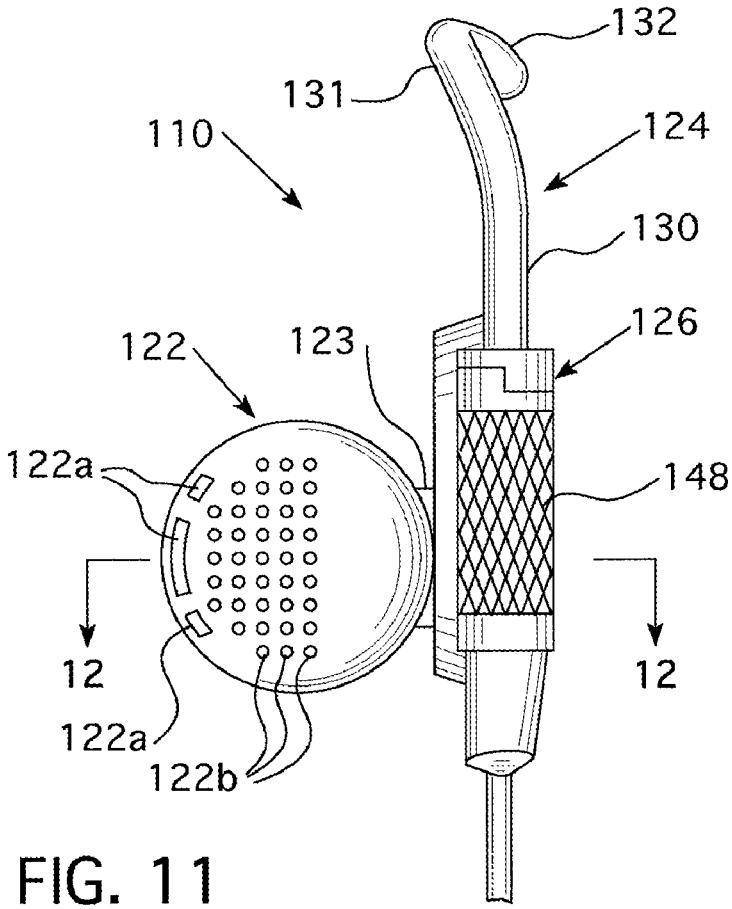
FIG. 11 is a front view view of the earphone of FIG. 10.

Referring now to FIGS. 1-4, 10-11, and 14, in various embodiments, the shape of the hanger bar may be described as follows. The first portion 30, 130 of the hanger bar 24, 124 may be generally vertical with respect to the second speaker element 22, 122 and/or the listener when the earphone 10, 110 is properly positioned on and/or in the listener's ear. The second portion 32, 132 may be generally horizontal likewise with respect to the second speaker element 22, 122 and/or the listener. The second portion 32, 132 may also slope or curve downward, back toward second speaker element 22, 122 as the second portion 32, 132 extends away from first portion 30, 130. Further, the second portion 32, 132 may also slope or curve horizontally inward, toward second speaker element 22, 122 as the second portion 32, 132 extends away from the first portion 30, 130. Optionally, as best seen in FIG. 11, the second portion 132 may connect to the first portion 130 by an intermediate portion 131 of hanger bar 124. Intermediate portion 131 may slope or curve toward second speaker element 122 as intermediate portion 131 transitions from the generally vertical first portion 130 to the generally horizontal second portion 132. In other words, the intermediate portion 131 serves to offset the first portion 130 from the second portion 132 such that the primary longitudinal axis for the first portion 130 does not intersect the primary longitudinal axis for the second portion 132.

Focusing now on FIG. 14, a top view is shown depicting the forces acting on and exerted by the earphone 110 when the earphone is worn on the listener's ear 12. In such embodiments, and without the need for gravitational assistance, the hanger bar 124 and second speaker element 122 may be adjusted relative to each other (as discussed above) such that the hanger bar 124 causes the second speaker element 122 to exert a force toward and/or on the cavum concha 15 and/or the ear canal 16 of the listener's ear 12 ($F_{in}$). In other words, the hanger bar 124 is sized and configured such that hanger bar 124 acts as a lever and is forced, by the listeners head 17, generally about fulcrum 18 (defined by a contact point between the second portion 132 of hanger bar 124 and the upper portion 13 of the auricula of the listener's ear 12), to cause the second speaker element 122 to exerts a force $F_{in}$ toward and/or on at least a portion of the listener's ear 12.

Mathematically, the force exerted toward and/or on the cavum concha 15 and/or the ear canal 16 ($F_{in}$) can be determined as follows. At equilibrium and about fulcrum 18, the torque exerted by the listener's head 17 on the second portion 132 of hanger bar 124 ($F_h \cdot D_h$) equals the torque experienced by the first portion 130 of hanger bar 124 ($F_e \cdot D_e$). Accordingly, the force balance equation yields the following:

$$F_h \cdot D_h = F_e \cdot D_e,$$

Solving for the force exerted on the first portion 130 ($F_e$) yields:

$$F_e = F_H \cdot \frac{D_h}{D_e}$$

Setting this force, $F_e$, equal to the force exerted on the ear by the first speaker element 120 ($F_c$) yields:

$$F_h \cdot D_h = F_c \cdot \left(D_e - \frac{D_l}{\cos(\theta)}\right)$$

Solving for $F_c$ yields:

$$F_c = \frac{F_h \cdot D_h}{D_e - \frac{D_l}{\cos(\theta)}}$$

Solving for the force exerted by the second speaker element 122 into the cavum concha 15 and/or ear canal 16 ($F_{in}$) yields:

$$F_{in} = F_c \cdot \cos(\beta)$$

Making substitutions yields an equation for the force of the second speaker element 122 into the ear cannel ($F_{in}$) which contains the following as variables: the force exerted from the head on the earphone 110 ($F_h$), the user defined distances ($D_h$, $D_e$, and $D_l$), and the user configured angles ($\alpha$ and $\theta$). This equation is as follows:

$$F_{in} = \frac{F_h \cdot D_h \cos(\alpha - (90° - \theta))}{D_e - \frac{D_l}{\cos(\theta)}}$$

Accordingly, the force exerted by the second speaker element 122 on the listener's ear ($F_{in}$) may be customizable to each listener such that people having different sized ears experience an appropriate amount of force to hold the speaker elements 120, 122 properly in place, independent of gravity and/or any force caused by gravity.

In various earphones, an in-ear speaker element may be sized and configured such that the element is held in place by forming a snug fit against the walls of the ear canal. However, in various embodiments, the second speaker element 122 may be sized such that the speaker element 122 is larger than the ear canal 122. In such embodiments, the second speaker element 122 may resist insertion into the ear canal and thus may be forced out away from the ear canal and/or the cavum concha by the internal walls of the listener's ear. Accordingly, the ability of the earphone 110 to supply an appropriate amount of force toward the listener's ear may be of further importance in order to maintain the proper position of the first and/or second speaker elements 120, 122 with respect to the listener's cavum concha and/or ear canal.

Figure 8:
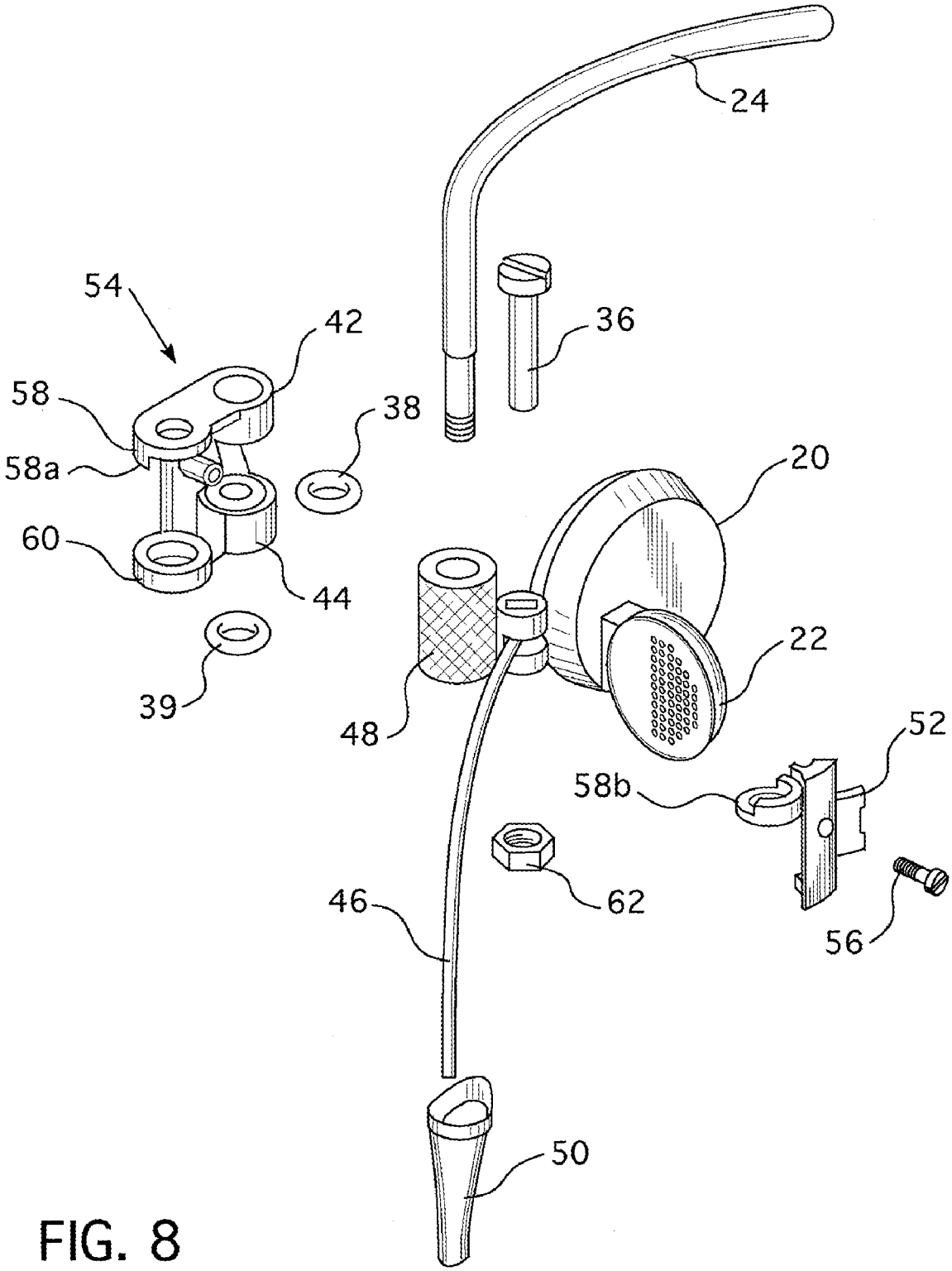
FIG. 8 is an exploded view of the earphone of FIG. 1.
Figure 9:
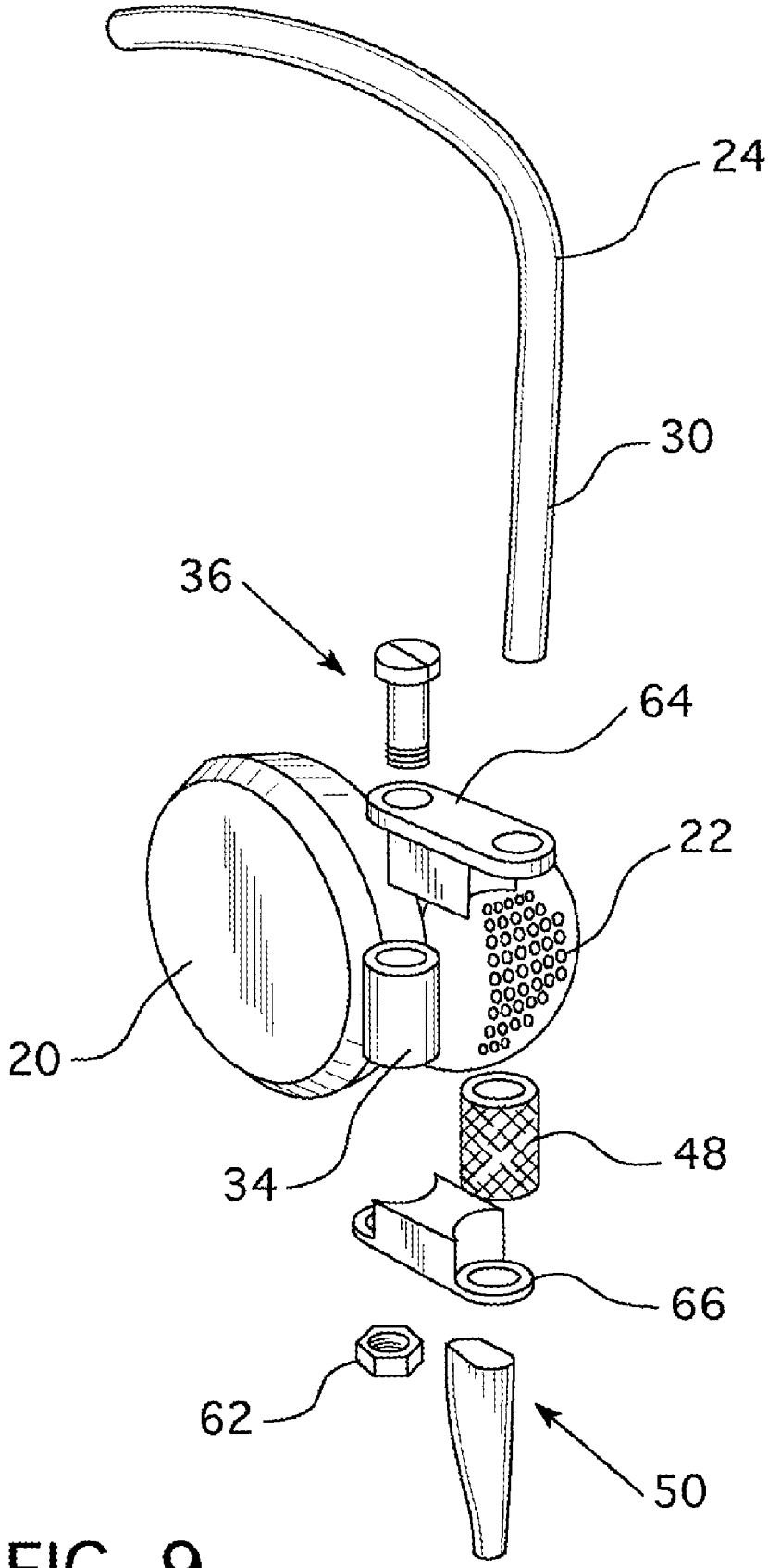
FIG. 9 is an exploded view of a non-limiting embodiment of an earphone.

FIG. 8 is an exploded view of the earphone 10 according to various embodiments. As shown in FIG. 8, the tragel bridge 26 may comprise front and back pieces 52, 54, connected together by a screw 56, for example. In other embodiment, other means of connecting the front and back pieces 52, 54 may be utilized, such as a snap fit. In addition, in other embodiments, the tragel bridge 26 may comprise fewer or greater than two separate pieces. In addition, rather than having front and back pieces as shown in FIG. 8, a tragel bridge may comprise upper and lower pieces 64, 66, as shown in FIG. 9, which shows an exploded view of a tragel bridge according to another embodiment.

Referring back to the embodiment of FIG. 8, the back piece 54 of the tragel bridge 26 may comprise the flanges 42, 44 that are above and below, respectively, the gudgeon 34. The tragel bridge 26 may also comprise, upper and lower proximal flanges 58, 60 that are above and below, respectively, the knurled knob 48. In the illustrated embodiment, the upper proximal flange 58 comprises two pieces, one piece 58*a* on the front piece 52 of the tragel bridge 26 and one piece 58*b* on the back piece 54 of the tragel bridge 26. In various embodiments, a plastic friction O-ring 39 may be disposed between the two pieces 58*a*, 58*b* of the upper proximal flange 58. The O-ring 39 may reside inside the tragel bridge 26 so that it cannot normally be seen. The purpose of the O-ring 39 is to provide friction between the first portion 30 of hanger bar 24 and the flange 58 of the tragel bridge 26 such that rotation of the hanger bar 24 relative to the tragel bridge 26 is resisted and a relative position may be maintained between the hanger bar 24 and the tragel bridge 26. Further, the O-ring 39 may provide a resistive biasing force such that the second speaker element 22 is biased toward the listener's ear after the hanger bar 24 is rotated away from tragel bridge 26. For example, the second portion 32 of hanger bar 24 may be rotated away from tragel bridge 26 and toward a listener's ear. Then, after the rotation is finished, the O-ring 39 may store resistive rotational energy such that the second portion 32 of the hanger bar 24 is biased back towards the tragel bridge 26. Accordingly, the second portion 32 of the hanger bar 24 and the second speaker element 22 may be biased toward each other when worn on a listener's ear. Alternatively, in various embodiments, the O-ring 39 may be omitted. In such embodiments, the upper proximal flange 58 may be sized and configured to directly provide rotational friction to the movement of the hanger bar passing therethrough. In any case, because of the rotational friction provided by either O-ring 39 and/or flange 58, a user may rotate the knob 48 such that the second portion 32 of the hanger bar 30 does not substantially rotate (because of the friction), but translates with respect to the tragel bridge 26. The tragel bridge 26 may also comprise a retaining nut 62 on the lower side of the gudgeon 34 that retains the pintle 36 in position.

Each of the first and second speaker elements 20, 22 may include respective acoustic transducers with dynamic drivers for producing sound waves in the audible range. The transducers may produce sound energy having different (although potentially overlapping) frequency ranges. For example, the first speaker element 20, being larger than the second speaker element 22, may produce low to mid frequencies in the audible range, and the second speaker element 22 may produce mid to high frequencies. According to at least one embodiment, the first speaker element 20 may comprise a transducer that is approximately 20 mm in diameter, and the second speaker element 22 may be approximately 12 mm in diameter. Alternatively, according to at least one embodiment, the first speaker element 20 may be approximately 20.0 mm in diameter and the second speaker element 22 may be approximately 13.5 mm in diameter.

As shown in FIGS. 3 and 4, the first speaker element 20 may comprise a low frequency transducer enclosure (LFTE) 70 on its inner portion 28 (i.e., the portion facing the ear 12) that may act as low pass acoustical filter for the first speaker element 20, effectively removing the high frequency component from the output of the driver for the first speaker element 20. In addition, the sound may emanate from the proximal surface 72 of the second speaker element 22. Additionally, the openings of the second speaker element 22 may be concentrated on the inner portion of the second speaker element 22 that extends furthest into cavum concha of the listener's ear 12. More details regarding dual element speakers are described in U.S. Pat. Nos. 4,418,248 and 5,333,206, both titled "DUAL ELEMENT HEADPHONE," which are incorporated herein by reference in their entireties.

Figure 12:
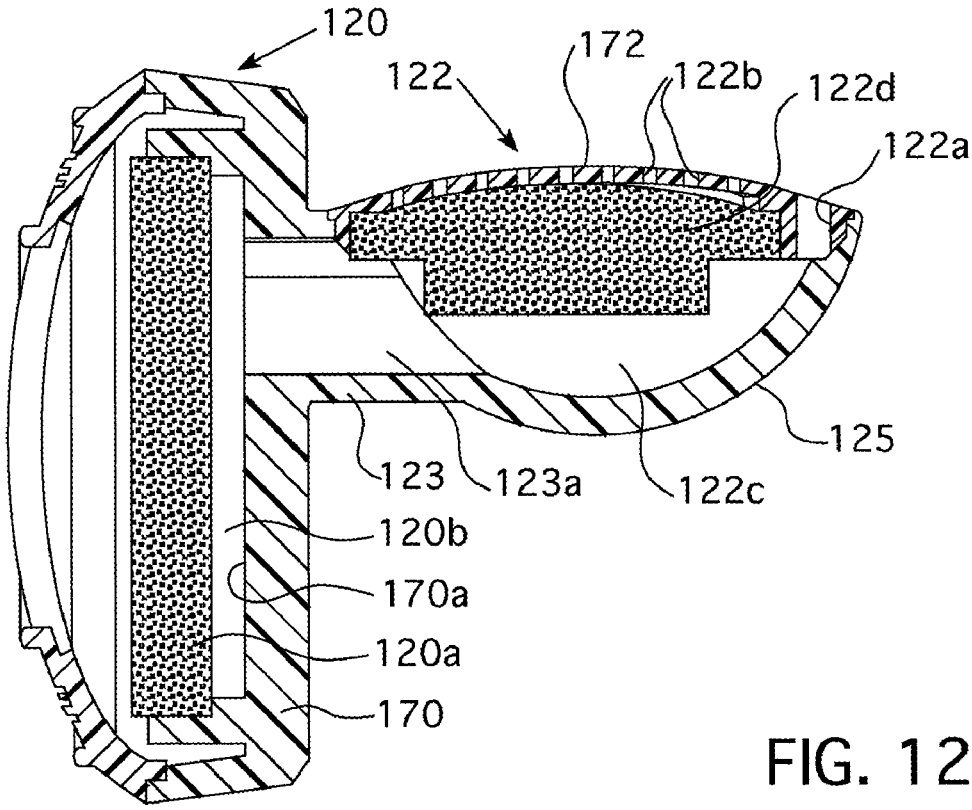
FIG. 12 is a cross-sectional view of speaker elements of the earphone of FIG. 10, taken along line 12-12 in FIG. 11 (any electrical wiring has been omitted for clarity)
Figure 13:
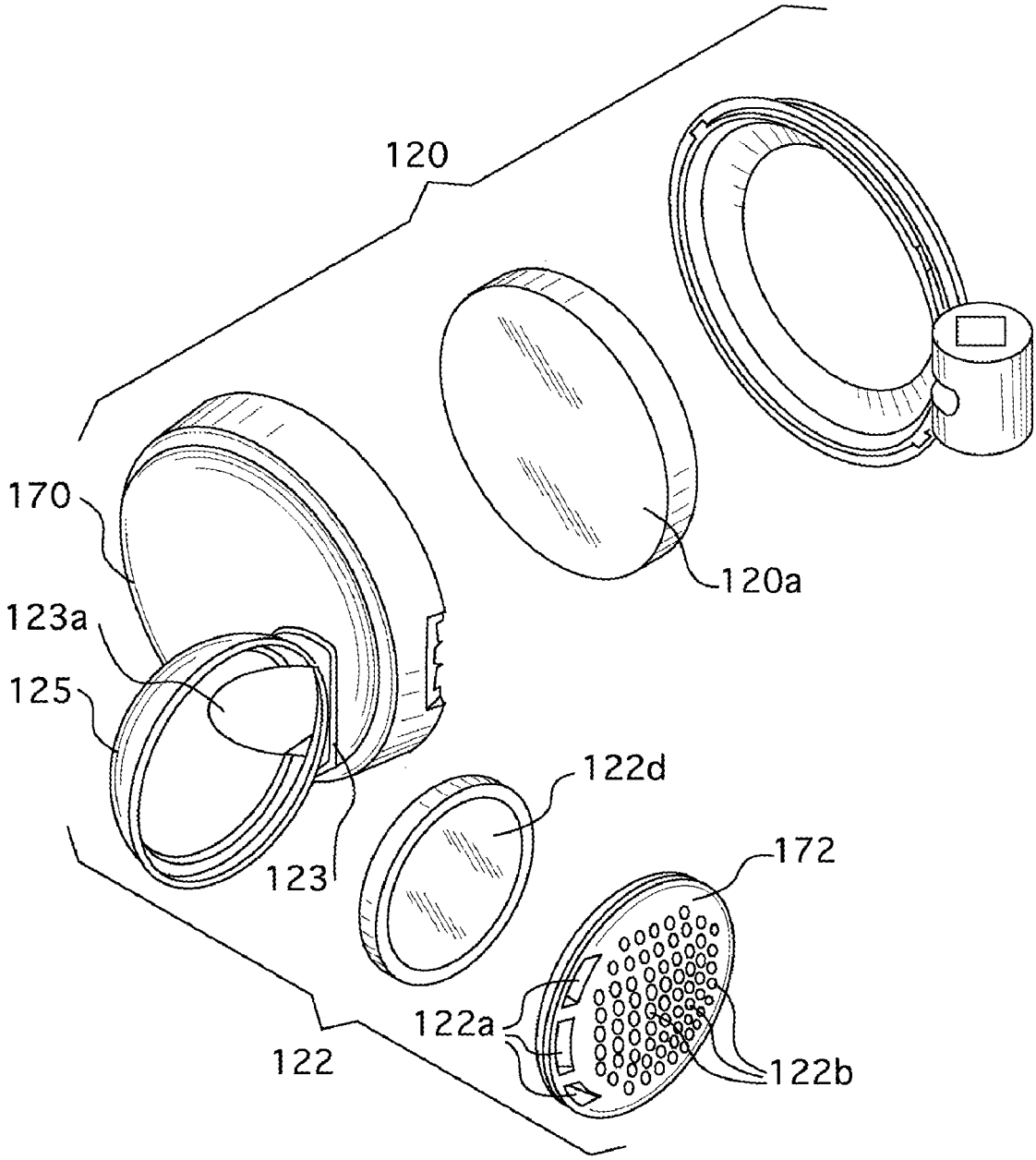
FIG. 13 is an exploded view of the speaker elements of the earphone of FIG. 10 (any electrical wiring has been omitted for clarity).

Further, in at least one embodiment, referring now to FIGS. 12-13, a sound path may be provided which delivers sound produced by a first transducer 120*a* of first speaker element 120 into the listener's concha and/or ear canal through second speaker element 122, for example. In such embodiments, the sound produced by the first transducer 120*a* may be initially directed into a first cavity 120*b* defined between an inner wall 170*a* of LFTE 170 and first transducer 120*a*. Then, the sound may pass through a channel 123*a* defined within arm 123 into second cavity 122*c*, which is defined behind second transducer 122*d* and in front of backing 125 of the second speaker element 122. From there, the sound produced by the first transducer 120*a* may emanate from the proximal surface 172 of the second speaker element 122 via first sound openings 122*a*. Sound produced by the second transducer 122*d* may likewise emanate from the proximal surface 172 of the second speaker element 122 via second sound openings 122*b*. Accordingly, the lower frequency sound produced by the first transducer 120*a* is mixed with the higher frequency sound produced by the second transducer 122*d* outside the earphone, but within the listener's ear, within his or her concha and/or ear canal, for example. Mixing the higher and lower frequency sound waves outside the earphone may be beneficial by preventing the lower frequency sounds produced by the first transducer 120*a* from interfering with the production of the higher frequency sounds coming from the second transducer. Therefore, in some embodiments, the second transducer is dampened from the lower frequency sound waves by sealing the second transducer within the housing of second speaker element 122, generally between cavity 122*c* and proximal surface 172. Accordingly, the sound path may also be configured to prevent the lower frequency sound wave energy from disturbing the second transducer 122*d* as the second transducer 122*d* modulates and creates the higher frequency sounds.

Additionally, again with reference to FIGS. 12-13, the first cavity 120*b*, the channel 123*a*, the second cavity 122*c*, and/or the first sound openings 122*a* may be sized and configured with respect to the first transducer 120*a* such that they define a sound path that acts as a low pass acoustical filter for the first transducer 120*a*, effectively removing the high frequency component from the output of the driver for the first transducer 120*a*. Therefore, because the sound path is selected such that it functions as an acoustical filter, in at least one embodiment, the electrical signal delivered to the first transducer 120*a*, and the signal delivered to the second transducer 122*d*, may not require an electronic filter. In other words, the earphone's electronic components may be subsequently simplified by removing the necessity for an electronic chip or other electronic parts or circuitry that provide signal filtering for the drivers of the transducers. This simplification is in-part due to sizing and configuring the path for the sound produced by the first transducer such that the sound path itself, and its defining surfaces, act as a low pass acoustical filter.

In some of the above-described embodiments, the second speaker element 22 may be connected fixedly to the first speaker element 20. According to other embodiments, the second speaker element 22 may be connected hingedly to the first speaker element 20 so that the second speaker element 22 can be rotated pivotably about a vertical axis of the hinge connecting the first and second speaker elements. That is, according to one embodiment, the second speaker element 22 may be rotated relative to the first speaker element 20 along curve C shown in FIG. 4.

According to yet other embodiments, the second speaker element 22 may be connected to the first speaker element 20 by a pivotable joint with multiple degrees of rotational freedom, such as a knuckle-ball joint or a ball joint. In other words, the second speaker element 22 may be rotated about any of three perpendicular axes, e.g. allowing for relative pitch, yaw, and/or roll motions, with respect to the first speaker element 20. In that case, in addition to being able to rotate pivotably along line C in FIG. 4, the second speaker element 22 could also be rotated about its horizontal axis (i.e., along curve D in FIG. 3) and rotated about a horizontal axis at the joint between the first speaker element 20 and the second speaker element 22 (i.e., along curve E in FIG. 3). Such multiple degrees of movement give the user more flexibility to adjust the relative positioning of the speaker elements 20, 22 for increased comfort.

In addition, in other embodiments, the first speaker element 20 may be connected to the tragel bridge 26 by a joint, such as a knuckle-ball joint or a ball joint, that allows multiple degrees of rotational freedom but limits or prevents translational movement. In other words, the first speaker element 20 may be rotated about any of three perpendicular axes, e.g. allowing for relative pitch, yaw, and/or roll motions, with respect to the tragel bridge 26. That way, the user may adjust the rotational orientation of the first speaker element 20 to enhance further the comfort of the earphone 10.

The examples presented herein are intended to illustrate potential and specific implementations of the embodiments. It can be appreciated that the examples are intended primarily for purposes of illustration for those skilled in the art. No particular aspect or aspects of the examples is/are intended to limit the scope of the described embodiments.

It is to be understood that the figures and descriptions of the embodiments have been simplified to illustrate elements that are relevant for a clear understanding of the embodiments. Because such elements are well known in the art and because they do not facilitate a better understanding of the embodiments, a discussion of such elements is not provided herein.

While various embodiments have been described herein, it should be apparent that various modifications, alterations, and adaptations to those embodiments may occur to persons skilled in the art with attainment of at least some of the advantages. The disclosed embodiments are intended to include all such modifications, alterations, and adaptations without departing from the scope of the embodiments as set forth herein.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. An earphone, comprising:

at least one speaker element;

a bridge comprising a first end and a second end, wherein the speaker element is pivotably connected to the first end of the bridge; and a hanger bar comprising a first portion and a second portion, wherein the first portion is threadingly connected to the second end of the bridge, wherein the second portion of the hanger bar is configured to rest upon a part of a listener's ear when the earphone is worn by the listener;

wherein the first end of the bridge defines a first axis, wherein the at least one speaker element may rotate about the first axis, wherein the second end of the bridge defines a second axis, and wherein the hanger bar is threadingly connected to the second end of the bridge such that the hanger bar may rotate about the second axis.

2. The earphone of claim 1, wherein the bridge further comprises a rotatable knob that is accessible to the listener, wherein the knob threadingly engages the first portion of the hanger bar such that rotation of the knob causes the second portion of the hanger bar to at least translate relative to the bridge.

3. The earphone of claim 2, wherein the second portion of the hanger bar and the bridge are separated by a distance and wherein the rotatable knob is configured such that rotation of the knob causes the distance to change.

4. The earphone of claim 1, wherein the at least one speaker element comprises a first speaker element and a second speaker element extending from the first speaker element, wherein the second speaker element is sized and configured to fit at least partially into a cavum concha of the listener's ear, and wherein the first speaker element is pivotably connected to the first end of the bridge.

5. The earphone of claim 4, wherein the second speaker element is connected to the first speaker element by a pivotable joint.

6. The earphone of claim 5, wherein the pivotable joint is configured to provide three degrees of rotational freedom to the second speaker element in relation to the first speaker element.

7. The earphone of claim 5, wherein the pivotable joint is a ball joint.

8. The earphone of claim 4, wherein the first speaker element is configured to produce a first sound in a first predetermined direction and the second speaker element is configured to produce a second sound in a second predetermined direction, wherein the first predetermined direction is transverse to the second predetermined direction.

9. The earphone of claim 4, wherein the first speaker element is pivotably connected to the first end of the bridge by a ball joint.

10. The earphone of claim 4, wherein the first speaker element is pivotably connected to the first end of the bridge by a hinged joint.

11. The earphone of claim 10, wherein the hinged joint defines a first axis, wherein the first speaker element may only rotate about the first axis, wherein the second end of the bridge defines a second axis, and wherein the hanger bar is threadingly connected to the second end of the bridge such that the hanger bar may only rotate about the second axis.

12. The earphone of claim 11, wherein the first axis and the second axis are substantially parallel.

13. The earphone of claim 1, wherein the first portion of the hanger bar comprises threads such that relative rotation of the second portion of the hanger bar to the bridge causes the second portion of the hanger bar to at least translate relative to the bridge.

14. The earphone of claim 1, wherein the bridge is configured to rest adjacent to a tragus of the listener's ear when the earphone is worn by the listener.

15. The earphone of claim 1, further comprising an O-ring disposed within the bridge, wherein the first portion of the hanger bar passes through the O-ring, wherein the O-ring is sized and configured to provide rotational friction to the first portion of the hanger bar passing therethrough.

16. An earphone, comprising:

at least one speaker element;

a bridge comprising a first end and a second end, wherein the speaker element is pivotably connected to the first end of the bridge, and wherein the second end comprises a rotatable knob, wherein the rotatable knob is accessible to a listener when the earphone is worn by the listener; and a hanger bar comprising a first portion and a second portion, wherein the first portion is operably engaged to the rotatable knob such that rotation of the knob causes the second portion to at least translate relative to the bridge, wherein the second portion of the hanger bar is configured to rest upon a part of the listener's ear when the earphone is worn by the listener.

17. The earphone of claim 16, wherein the at least one speaker element comprises a first speaker element and a second speaker element extending from the first speaker element, wherein the second speaker element is sized and configured to fit at least partially into a cavum concha of the listener's ear, and wherein the first speaker element is pivotably connected to the first end of the bridge.

18. The earphone of claim 17, wherein the second speaker element is connected to the first speaker element by a pivotable joint.

19. The earphone of claim 18, wherein the pivotable joint is configured to provide three degrees of rotational freedom to the second speaker element in relation to the first speaker element.

20. The earphone of claim 18, wherein the pivotable joint is a ball joint.

21. The earphone of claim 17, wherein the first speaker element is configured to produce a first sound in a first predetermined direction and the second speaker element is configured to produce a second sound in a second predetermined direction, wherein the first predetermined direction is transverse to the second predetermined direction.

22. The earphone of claim 17, wherein the first speaker element is pivotably connected to the first end of the bridge by a ball joint.

23. The earphone of claim 17, wherein the first speaker element is pivotably connected to the first end of the bridge by a hinged joint.

24. The earphone of claim 23, wherein the hinged joint defines a first axis, wherein the first speaker element may only rotate about the first axis, wherein the rotatable knob defines a second axis, and wherein the hanger bar is operably engaged to the rotatable knob such that the hanger bar may only rotate about the second axis.

25. The earphone of claim 24, wherein the first axis and the second axis are substantially parallel.

26. The earphone of claim 16, wherein the bridge is configured to rest adjacent to a tragus of the listener's ear when the earphone is worn by the listener.

27. The earphone of claim 16, further comprising an O-ring disposed within the bridge, wherein the first portion of the hanger bar passes through the O-ring, wherein the O-ring is sized and configured to provide rotational friction to the first portion of the hanger bar passing therethrough.

28. A method of wearing an earphone, the method comprising the steps of:

providing an earphone comprising:

at least one speaker element;

a bridge comprising a first end and a second end, wherein the speaker element is pivotably connected to the first end of the bridge, and wherein the second end comprises a rotatable knob; and a hanger bar comprising a first portion and a second portion, wherein the first portion is operably engaged to the rotatable knob such that rotation of the knob causes the second portion of the hanger bar to at least translate relative to the bridge;

rotating the knob to adjust a distance between the second portion of the hanger bar and the bridge;

rotating the speaker element relative to the bridge;

resting the hanger bar on part of a listener's ear such that the speaker element is aligned with the cavum concha of the listener's ear.

29. The method of claim 28, wherein the step of resting further comprises resting the hanger bar on a portion of a listener's ear such that the bridge sits adjacent to the tragus of the listener's ear.

30. The method of claim 28, further comprising the step of rotating the second portion of the hanger bar relative to the bridge.

31. The method of claim 28, wherein the at least one speaker element of the earphone further comprises a first speaker element and a second speaker element extending from the first speaker element, wherein the second speaker element is sized and configured to fit at least partially into a cavum concha of the listener's ear, and wherein the first speaker element is pivotably connected to the first end of the bridge, and further comprising the step of placing the second speaker element at least partially into the cavum concha of the listener's ear.

32. An earphone, comprising:

a first speaker element comprising:

an enclosure having a wall, a first transducer disposed within the enclosure, the first transducer configured to produce a first sound; and a first cavity defined between the wall of the enclosure and the first transducer; and a second speaker element extending from the first speaker element, the second speaker element comprising:

a housing sized and configured to fit at least partially into a cavum concha of a listener's ear, the housing having a backing and a sound emanating surface, wherein the sound emanating surface includes first sound openings and second sound openings defined therein;

a second transducer disposed within the housing, the second transducer configured to produce a second sound that emanates through the second sound openings but not through the first sound openings; and a second cavity defined between the backing of the housing and the second transducer;

wherein the first cavity, the second cavity, and the first sound openings define a sound path for the first sound produced by the first transducer such that the first sound travels through the sound path and emanates through the first sound openings but not through the second sound openings.

33. The earphone of claim 32, further comprising an arm connecting the first speaker element to the second speaker element, wherein the arm defines a channel therein, and wherein the first cavity is connected to the channel, the channel is connected to the second cavity, and the second cavity is connected to the first sound openings, such that the first cavity, the channel, the second cavity, and the first sound openings define the sound path.

34. The earphone of claim 32, wherein the sound path is sized and configured such that the path functions as a low pass acoustical filter for the first transducer.

35. The earphone of claim 34, wherein the first sound is acoustically filtered by the sound path such that the first sound has a lower frequency when the first sound emanates from the first sound openings than the frequency of the second sound that emanates from the second sound openings.

36. The earphone of claim 32, further comprising a bridge comprising a first end and a second end, wherein the first speaker element is pivotably connected to the first end of the bridge, and a hanger bar comprising a first portion and a second portion, wherein the first portion is threadingly connected to the second end of the bridge, wherein the second portion of the hanger bar is configured to rest upon a part of a listener's ear when the earphone is worn by the listener.

37. The earphone of claim 32, further comprising a bridge comprising a first end and a second end, wherein the first speaker element is pivotably connected to the first end of the bridge, and wherein the second end comprises a rotatable knob, wherein the rotatable knob is accessible to a listener when the earphone is worn by the listener, and a hanger bar comprising a first portion and a second portion, wherein the first portion is operably engaged to the rotatable knob such that rotation of the knob causes the second portion to at least translate relative to the bridge, wherein the second portion of the hanger bar is configured to rest upon a part of the listener's ear when the earphone is worn by the listener.

38. The earphone of claim 37, further comprising an O-ring disposed within the bridge, wherein the first portion of the hanger bar passes through the O-ring, wherein the O-ring is sized and configured to provide rotational friction to the first portion of the hanger bar passing therethrough.

39. An earphone, comprising:

at least one speaker element configured to fit at least partially into a cavum concha of a listener's ear; and a hanger bar operably connected to the speaker element, wherein the hanger bar is configured to rest upon an upper external curvature of a listener's ear and behind an upper portion of an auricula of the listener's ear, wherein the hanger bar has a shape configured to cause the speaker element to exert a force on the listener's ear, independent of gravity.

40. The earphone of claim 39, wherein the hanger bar shape comprises a first portion and a second portion, wherein the first portion is operably connected to the speaker element, and wherein the second portion of the hanger bar is configured to rest upon the upper external curvature of the listener's ear and behind the upper portion of the auricula of the listener's ear, and wherein, when the earphone is worn by the listener and with respect to the listener, the first portion extends generally vertically, the second portion extends generally horizontally and curves downward, toward the speaker element, and the second portion also curves inward, toward the speaker element.

41. The earphone of claim 40, wherein the hanger bar shape further comprises an intermediate portion disposed between the first portion and the second portion, wherein the intermediate portion slopes toward the speaker element.

42. The earphone of claim 40, wherein the second portion of the hanger bar shape defines a longitudinal axis comprising a curve that is nonplanar.

43. The earphone of claim 41, wherein the first portion defines a first longitudinal axis and the second portion defines a second longitudinal axis, wherein the first longitudinal axis and the second longitudinal axis do not intersect.

44. The earphone of claim 1, wherein the first axis and the second axis are not collinear.

45. The earphone of claim 44, wherein the first axis and the second axis are substantially parallel.

46. The earphone of claim 11, wherein the first axis and the second axis are not collinear.

47. The earphone of claim 12, wherein the first axis and the second axis are not collinear.

48. The earphone of claim 16, wherein the first end of the bridge defines a first axis, wherein the first speaker element may rotate about the first axis, wherein the rotatable knob defines a second axis, and wherein the hanger bar is operably engaged to the rotatable knob such that the hanger bar may rotate about the second axis.

49. The earphone of claim 48, wherein the first axis and the second axis are not collinear.

50. The earphone of claim 49, wherein the first axis and the second axis are substantially parallel.

51. The earphone of claim 24, wherein the first axis and the second axis are not collinear.

52. The earphone of claim 25, wherein the first axis and the second axis are not collinear.

* * * * *

UNITED STATES PATENT AND TRADEMARK OFFICE

CERTIFICATE OF CORRECTION

PATENT NO. : 8,103,040 B2
APPLICATION NO. : 12/990431
DATED : January 24, 2012
INVENTOR(S) : Pelland et al.

It is certified that error appears in the above-identified patent and that said Letters Patent is hereby corrected as shown below:

ABSTRACT

Delete "other element (is not." and substitute therefor --other element is not.--

ABSTRACT

Delete "A hinged joint may allow the larger speaker element may be rotated" and substitute therefor --A hinged joint may allow the larger speaker element to be rotated--.

COL. 4, LINE 32

Delete ""vertical" and horizontal" are" and substitute therefor --"vertical" and "horizontal" are--.

COL. 4, LINE 39

Delete "and may be extend outwardly" and substitute therefor --and may extend outwardly--.

COL. 6, LINE 28

Delete "knurled knob 48 at is proximal" and substitute therefor --knurled knob 48 at its proximal--.

COL. 6, LINE 32

Delete "is correctly position on the" and substitute therefor --is correctly positioned on the--.

COL. 7, LINE 13

Delete "the second speaker element 122 to exerts a force" and substitute therefor --the second speaker element 122 to exert a force--.

COL. 8, LINE 19

Delete "In other embodiment," and substitute therefor --In other embodiments--.

Signed and Sealed this
Twenty-eighth Day of August, 2012

David J. Kappos

David J. Kappos
*Director of the United States Patent and Trademark Office*